United States Patent [19]

Penney et al.

[11] 4,345,304

[45] Aug. 17, 1982

[54] RECHARGEABLE LAMP ASSEMBLY, MOUNTING UNIT, AND CIRCUIT THEREFOR

[75] Inventors: C. Bradford Penney, Norristown, Pa.; Glenn M. Zabec, Franklin Park; Sri P. Sridharan, Hickory Hills, both of Ill.

[73] Assignee: Streamlight, Inc., Norristown, Pa.

[21] Appl. No.: 126,967

[22] Filed: Mar. 3, 1980

[51] Int. Cl.[3] ..... F21L 7/00

[52] U.S. Cl. ..... 362/183; 362/191; 362/196; 362/200; 362/205; 362/226

[58] Field of Search ..... 362/226, 183, 191, 196, 362/200, 205

[56] References Cited

U.S. PATENT DOCUMENTS 3,441,730 4/1969 Doring et al. ..... 362/183

*Primary Examiner*—Stephen J. Lechert, Jr.

*Attorney, Agent, or Firm*—Robert Scobey

[57] ABSTRACT

A rechargeable lamp assembly utilizing recharging contacts and a mounting unit for recharging purposes that contains mating contacts so that the lamp unit may be recharged when mounted on the mounting unit. The mounting unit includes another set of electrical contacts of the same configuration as those on the lamp unit. Thus a recharging unit for generating a recharging current may be utilized which is connectable either to the mounting unit, to recharge the lamp unit mounted thereon, or directly to the lamp unit. The lamp unit circuitry is adapted to accept any of a number of different recharging units, so as to provide for recharging from a battery source, an AC source, and an AC source with input power-failure indication. The bulb in the lamp unit may be releasably connected to the battery, so that the battery potential may be taken off as an independent power supply for another load, if desired.

8 Claims, 12 Drawing Figures

RECHARGEABLE LAMP ASSEMBLY, MOUNTING UNIT, AND CIRCUIT THEREFOR

BACKGROUND AND BRIEF DESCRIPTION OF THE INVENTION

This invention relates to lamp assemblies, and particularly to a rechargeable lamp assembly. Rechargeable lamps are known, and most generally involve a recharging unit that is wall mounted and then connectable to a power supply. The recharging unit is not portable, and hence it is necessary to have separate recharging units in all locations in which the lamp is to be used, or always return the lamp to a location in which a single recharging unit is located.

The present invention provides a rechargeable lamp assembly that is very versatile. The mounting function for positioning the lamp unit for recharging purposes (including storage purposes) is made versatile so that charging can be done through the mounting unit or separately, not utilizing the mounting unit. To this end the mounting unit includes contacts which mate with similar contacts on the lamp unit. However, the mounting unit is not directly connected to a recharging unit with a permanent connection, but rather is connected by a disconnectable connection to that recharging unit. Thus, the recharging unit is either connected to the mounting unit to recharge the lamp that is mounted thereon, or the recharging unit is directly connected to the lamp to recharge it. This provides great versatility in use since one or more mounting units may be mounted where desired to store the lamp unit and to recharge it. Additionally, a recharging unit may be individually employed, utilizable with any one of the mounting units or with the lamp unit directly.

Circuitry within the lamp unit is adapted for a number of different modes of operation. In particular, recharging of the battery may be done through a battery input, an alternating current input that is rectified, or the latter type of input with a feature which provides for automatic lamp operation to light the bulb in the lamp whenever, in a charging mode, the input power fails for some reason. These options are all accommodated by a single lamp unit circuit, in combination with different recharging units.

The bulb in the lamp unit may be readily disconnectable from the battery, and battery output power terminals may be provided as a result to permit the lamp unit to be used as a battery power outlet source for another load, as desired.

The lamp unit is preferably formed from a housing which is molded from various parts, and in which a storage chamber is provided above the battery within the lamp unit, with a cover closing off the storage chamber and slidable for gaining access to that chamber.

The invention is thus directed to a versatile rechargeable lamp assembly. A presently preferred embodiment of the invention is described as follows.

DETAILED DESCRIPTION

Figure 1:
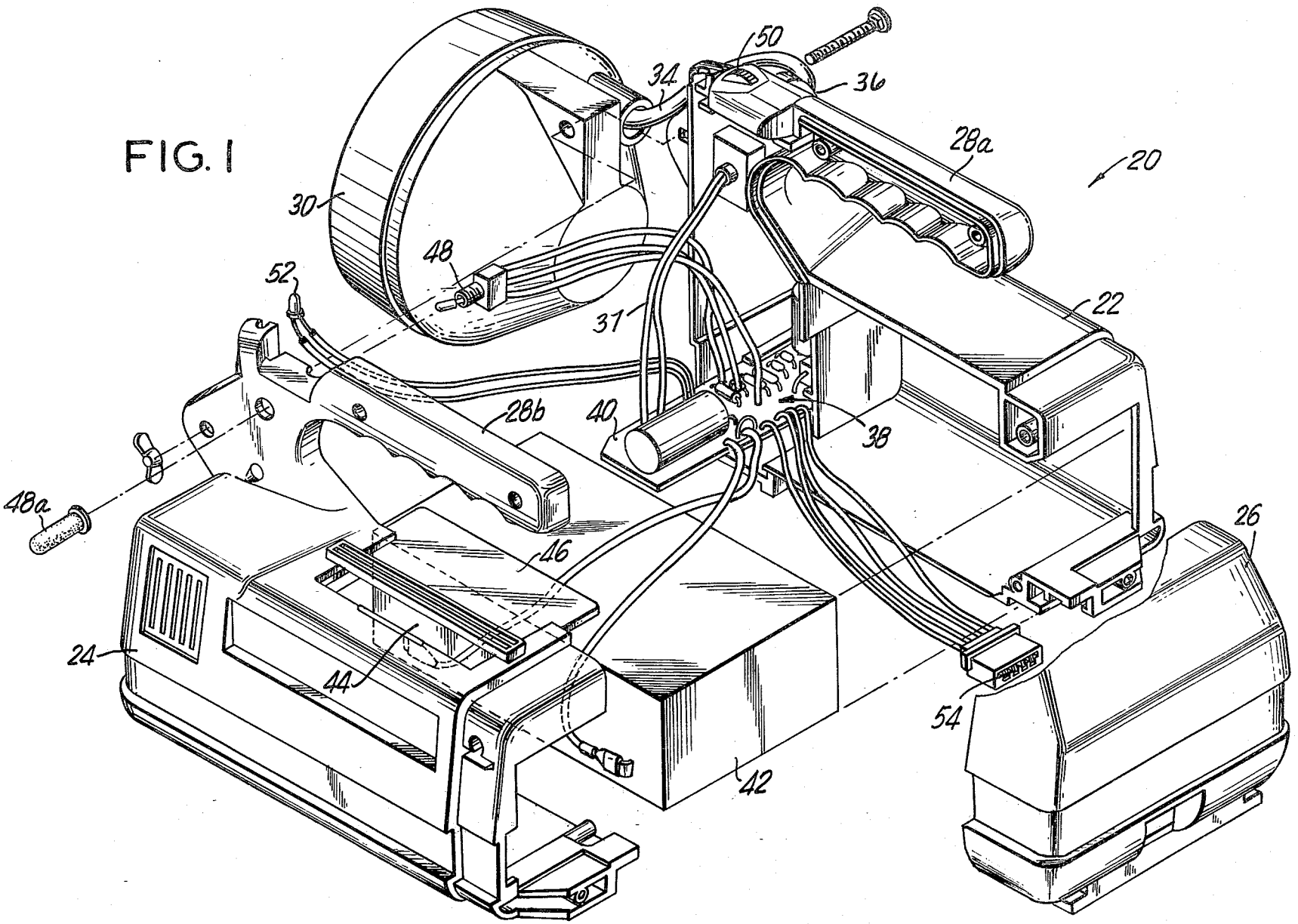
FIG. 1 is an exploded perspective view of a rechargeable lamp assembly embodying the invention.
Figure 2:
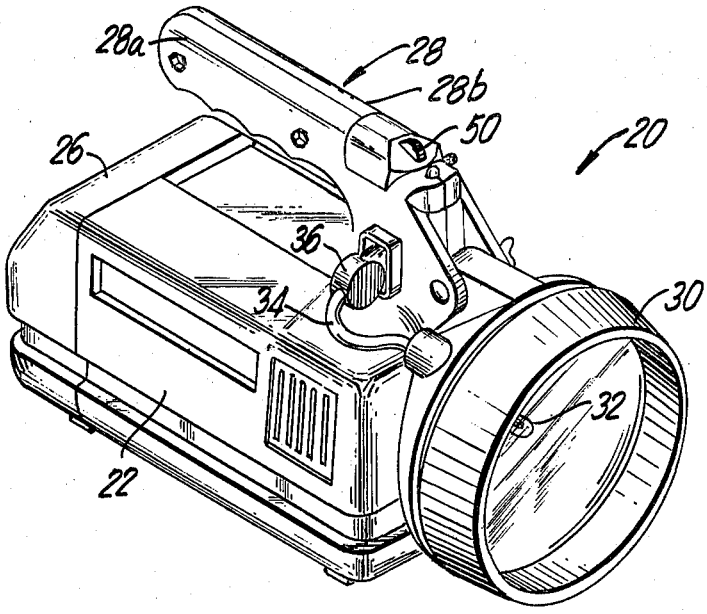
FIG. 2 is a perspective view of the rechargeable lamp assembly of FIG. 1, in assembled form.
Figure 4:
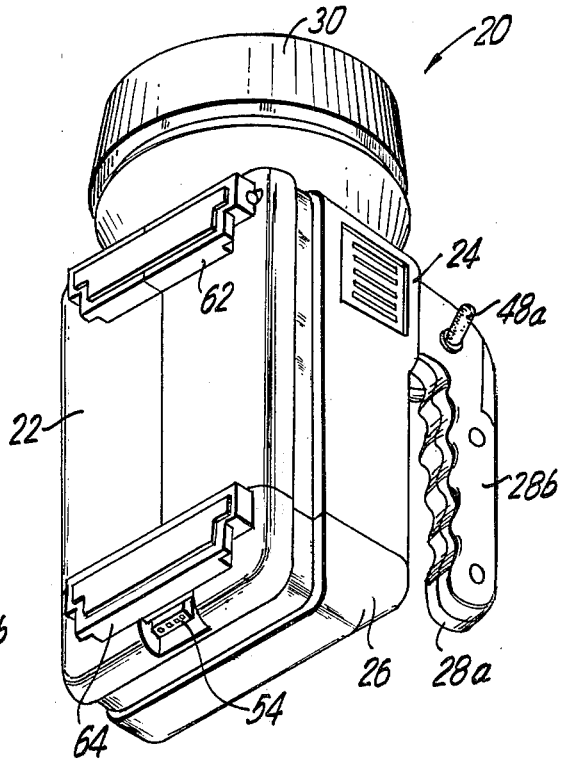
FIG. 4 is a rear perspective view of the lamp assembly of FIG. 2.

Referring to FIG. 1, a rechargeable lamp assembly 20 is shown, advantageously formed from molded side parts 22 and 24 which mate together, and a complimentary mating end section 26. The assembled unit is shown in FIGS. 2 and 4. The unit includes a handle portion 28, formed from interfitting parts 28*a* and 28*b*. A bulb holder 30 is included which is swivel mounted as shown in FIG. 2, and includes bulb 32 therein. The bulb is connected by a flexible cable 34 through a strain relief 36 and via conductors 37 to circuitry 38 within the lamp unit. The circuitry is constituted of wiring and various circuit elements that are mounted on a circuit board 40 (FIG. 1). If desired, the element 36 may be a disconnectable connection, rather than simply a strain relief, in which case the bulb 32 may be electrically disconnected from the remainder of the lamp unit, and the exposed terminals in the lamp unit may be used as power outlet terminals for another load, such as a battery driven drill or the like.

As shown in FIG. 1, a battery 42 is mounted within the lamp unit housing, and is positioned so that a chamber 44 is formed thereover. The chamber 44 advantageously constitutes a storage chamber, and a cover 46 which is slidable may be used to close off the chamber, slid to its open position for gaining access to the chamber.

The lamp unit includes an on/off switch 48, which may be covered by a flexible cover 48*a* to protect the switch from the elements. The on/off switch 48 may constitute a switch controlling "bulb operation" and "battery charging" modes of operation. A knurled switch 50 may be included in the lamp unit, at the top of the handle portion 28, as desired, in the event that additional control of the lamp unit is desired, such as dimming. An indicator 52 is also included, which is normally lighted whenever the battery 42 contains a sufficient charge for continued operation of the lamp unit.

The lamp unit includes a first set 54 of electrical contacts of particular configuration which are connected to the circuit elements 38 for recharging purposes. These electrical contacts are adapted for releasable connection to a mating second set 56 of electrical contacts contained in a mounting unit 58 shown in FIG. 3. The mounting unit 58 is used for mounting the lamp unit 20 for storage of that lamp unit and for recharging of that lamp unit, as will now be described. Briefly, however, when the lamp unit 20 is mounted on the mounting unit 58, the first set 54 of electrical contacts in the lamp unit mate with the second set 56 of electrical contacts in the mounting unit 58. The second set 56 of electrical contacts are connected to a third set 59 of electrical contacts which are of the same configuration as the first set 54 within the lamp unit 20. This third set 59 of electrical contacts the same as the first set 54 are employed to facilitate charging operations, as will now be described.

Figure 3:
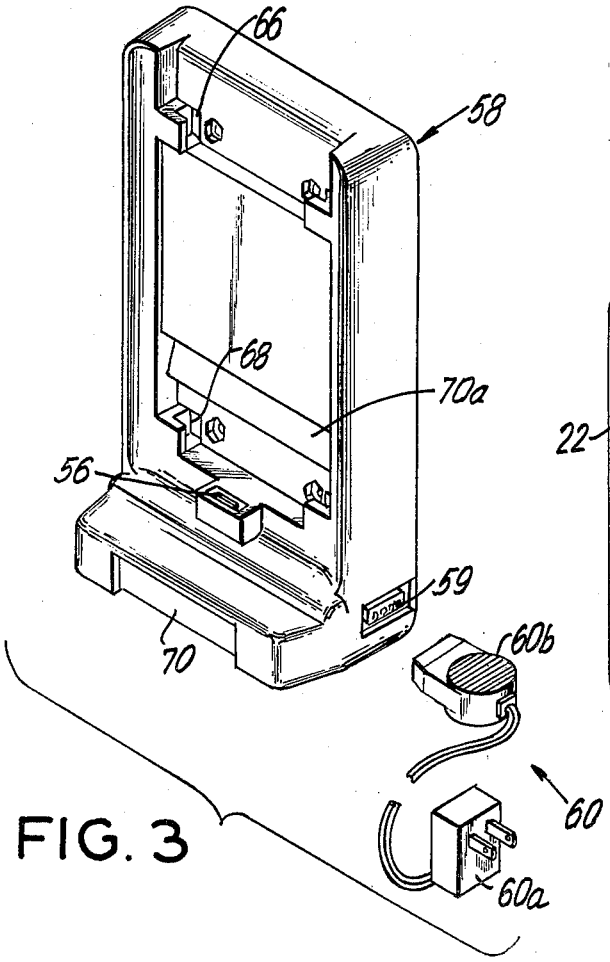
FIG. 3 is a perspective view of a mounting unit and recharging unit embodying the invention and useful with the lamp assembly of FIGS. 1 and 2.

In particular, a recharging unit 60 shown in FIG. 3 may be employed for recharging the lamp unit 20. That recharging unit may include a part 60*a* thereof adapted to be energized by a conventional 115 volt alternating current source. The unit 60*a* may include a transformer and diode network, representative forms of which will be described below, which converts the alternating current potential to some lower, dc value suitable for charging the battery 42 in the lamp unit. The recharging unit 60 is terminated by a coupling 60*b* which includes a fourth set of electrical contacts (not shown in FIG. 3) which are of the same configuration as the second set 56 of electrical contacts within the mounting unit 58. Thus, the portion 60*b* of the recharging unit 60 may be releasably connected to the electrical contacts 59 in the mounting unit 58, thereby to energize the contacts 56 in the mounting unit and the contacts 54 of the lamp unit 20 mating therewith. Alternatively, if it is desired to charge the lamp unit directly, lamp unit 20 may be removed from the mounting unit 58, and the terminal end 60*b* releasably connected to the contacts 54 in the lamp unit.

This arrangement gives great versatility to the overall rechargeable lamp assembly. In other words, any number of mounting units 58 may be employed, mounted where convenient for the storage and recharging of a single lamp unit 20. A single recharging unit, such as the recharging unit shown in FIG. 3 may be employed with any one of the mounting units 58 or directly with the lamp unit 20.

Figure 5:
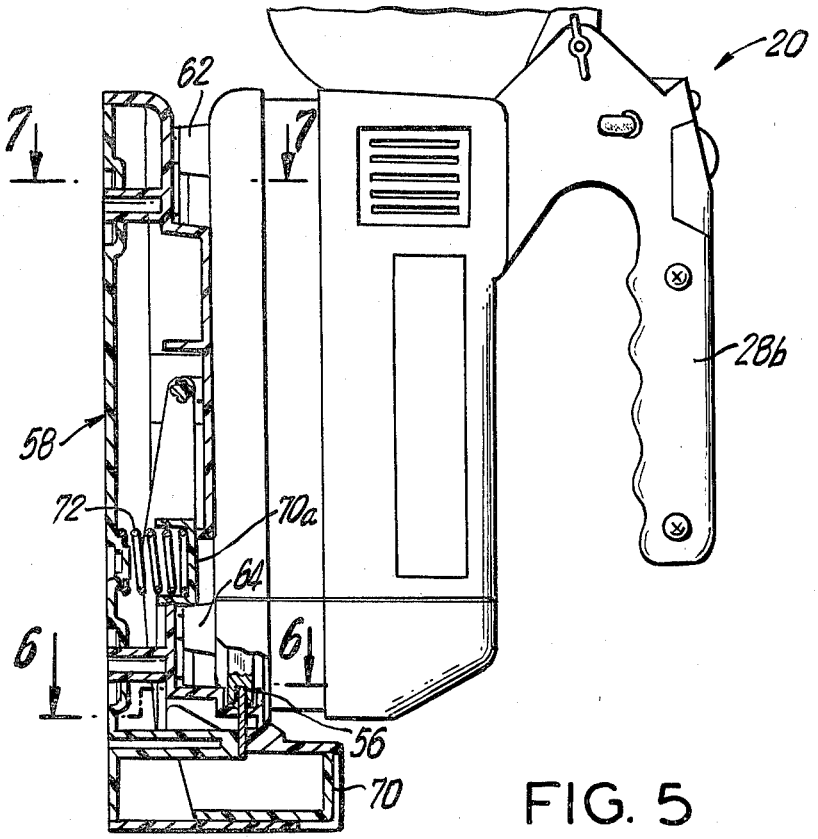
FIG. 5 is a side view of the lamp assembly of FIGS. 2 and 4 mounted in the mounting unit of FIG. 3, with the mounting unit being shown in section, and the lamp assembly being shown partly in section.
Figure 6:
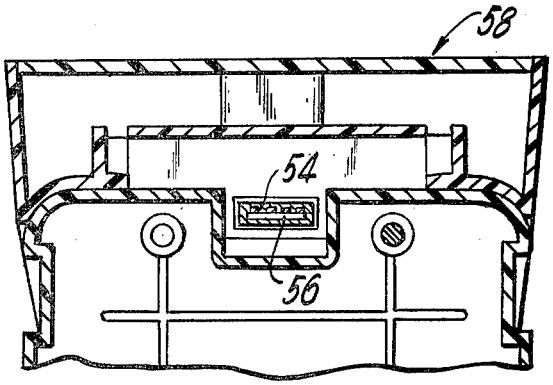
FIGS. 6 and 7 are sectional views, taken along the sections 6—6 and 7—7 in FIG. 5.
Figure 7:
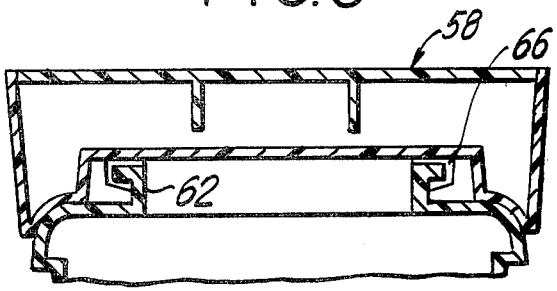

FIGS. 5 to 7 show the details of the releasable mounting of the lamp unit 20 to the mounting unit 58. In particular, and also referring to FIG. 4, the lamp unit 20 includes mounting lugs 62 and 64. These mounting lugs are slidable in trackways 66 and 68 in the mounting unit 58 shown in FIG. 3. That mounting unit includes a spring biased plate 70. Spring 72 shown in FIG. 5 is used for biasing the plate to the right as shown in FIG. 5. That plate includes a portion 70*a* shown in FIG. 3 and also in FIG. 5 which engages the lower mounting lug 64 shown in FIG. 4. FIG. 5 shows the engagement of the lower mounting lug 64 with the spring biased plate. Thus, the lower mounting lug 64 constitutes a catch plate which engages the spring biased plate 70*a* to releasably hold the lamp unit 20 to the mounting unit 58. When it is desired to release the lamp unit from the mounting unit, the plate portion 70 is pushed inwardly (to the left with respect to FIG. 5), causing the portion 70*a* to move inwardly to the left in FIG. 5 away from the catch plate 64, permitting the lamp unit 20 to be slid within the trackways 66 and 68 and to be removed from the mounting unit.

Figure 8:
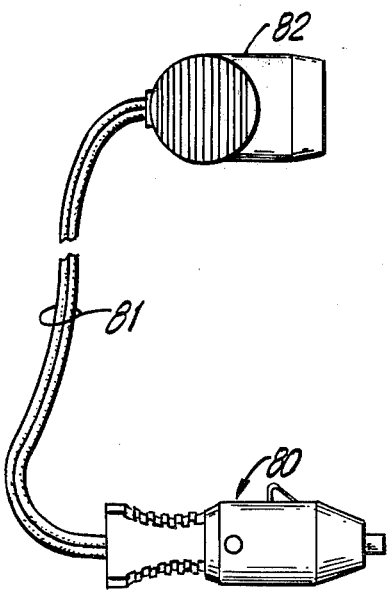
FIG. 8 shows a recharging unit suitable for automobile-battery recharging of the lamp assembly of FIGS. 1, 2 and 4.
Figure 9:
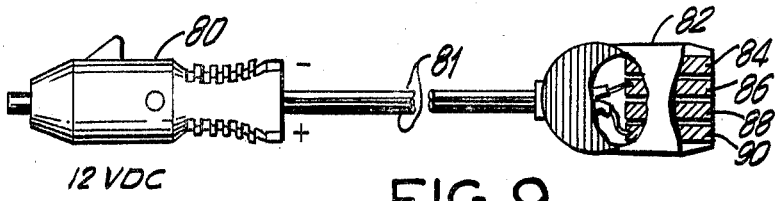
FIG. 9 is a view of a recharging unit similar to that of FIG. 8.
Figure 10:
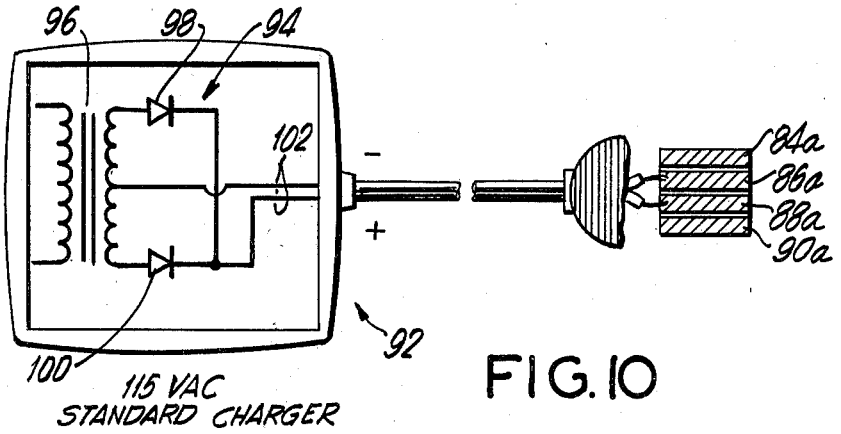
FIGS. 10 and 11 are views of alternative recharging units.
Figure 11:
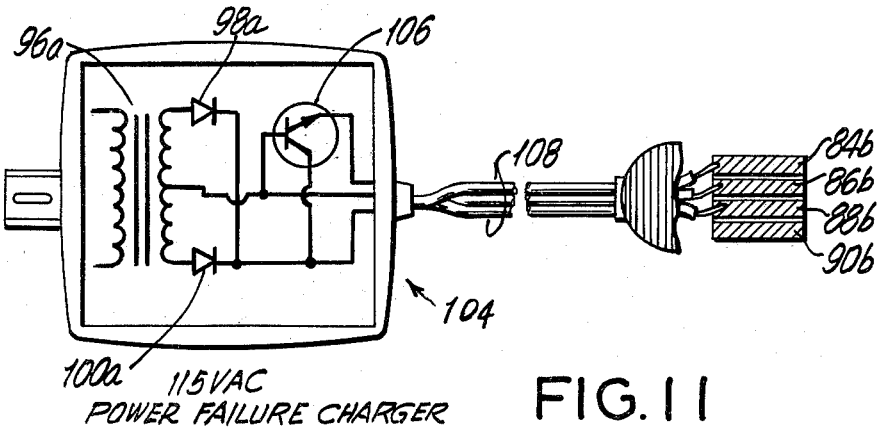
Figure 12:
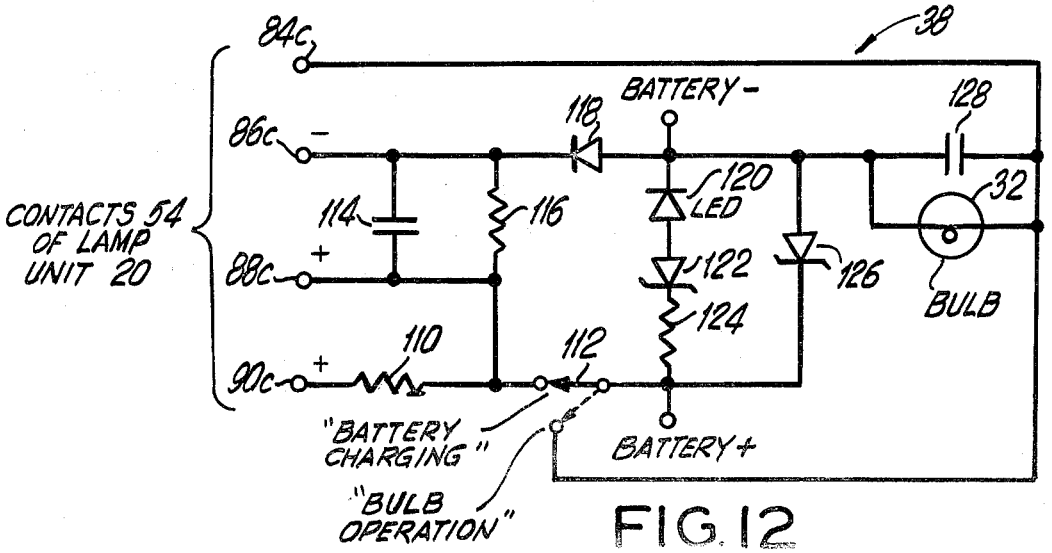
FIG. 12 is a schematic circuit diagram of a presently preferred circuit used in the lamp assembly of FIGS. 1, 2 and 4.

The versatility of the overall lamp assembly is illustrated by the use of various recharging units, shown in FIGS. 8 to 11 and the lamp circuitry shown in FIG. 12. The recharging unit shown in FIGS. 8 and 9 is adapted to provide for recharging of the battery 42 in the lamp unit 20 by any suitable dc source such as a battery in an automobile. The portion 80 of the recharging unit is conventional, and is adapted for insertion into the conventional cigar lighter receptacle. Power from any suitable dc source is thus supplied by a flexible cable 81 to terminal portion 82. That terminal portion includes four electrical contacts 84, 86, 88 and 90, only two of which (contacts 86 and 90) are used. These electrical contacts mate with the contacts 59 of the mounting unit 58 shown in FIG. 3 as well as with the electrical contacts 54 of the lamp unit 20 shown in FIG. 1. FIG. 10 shows a recharging unit 92 of the general type of unit 60 shown in FIG. 3, namely, for use with 115 volt alternating current supplied. The recharging unit 92 shown in FIG. 10 includes a circuit 94 in the interior thereof constituted by a transformer 96 used to reduce the alternating current potential to a usable value in recharging the battery 42 and diodes 98 and 100 to rectify the alternating current and to produce a dc signal on output conductors 102. In this case, the output conductors are connected to contacts 86*a* and 88*a* of a four contact set (contacts 84*a*, 86*a*, 88*a* and 90*a*). These contacts are of the same configuration as those described in connection with FIG. 9 and mate with the contacts 59 of the mounting unit 58 or the contacts 54 in the lamp unit 20.

FIG. 11 shows a recharging unit 104. It is similar to the unit 92 in that it includes a transformer 96*a* and diodes 98*a* and 100*a*. In this case, a transistor 106 is included used to sense a power failure in the recharging unit 104. In this case, the recharging unit 104 includes a three conductor flexible output conductor 108, the conductors of which are connected to contacts 84*b*, 86*b* and 88*b* of the four contact set described above.

All of these recharging units are used with the circuit shown in FIG. 12. As noted above, that circuit constitutes the circuit 38 included in the lamp unit. The circuit includes input terminals 84*c*, 86*c*, 88*c*, and 90*c*. These terminals mate with the corresponding numbered terminals of the recharging units shown in FIGS. 9 to 11. The terminals 84*c*–90*c* also constitute the electrical contacts 54 shown in FIG. 1 of the lamp unit 20. The terminal 90*c* is connected through a current limiting resistor 110 to the "battery charging" terminal of a switch 112. That same switch terminal is also connected to terminal 88*c* in the circuit. Terminals 86*c* and 88*c* are bridged by a capacitor 114 and resistor 116 used for filtering pulses in the charging potential. A diode 118 is included to trigger the base of transistor 106 whenever the input power to recharging unit 104 fails. The battery 42 in the lamp unit is represented by the terminals marked "Battery−" and "Battery+". A light emitting diode 120 is included, along with a Zener diode 122 and resistor 124 connected across the terminals of the battery 42. The light emitting diode 120 is energized whenever the battery 42 is of sufficient potential to operate the lamp unit. The Zener diode 122 opens at a low voltage condition of the battery 42 (for example, 4.7 volts of battery potential), thereby extinguishing the light emitting diode and indicating to the user of the lamp assembly that the battery needs recharging. A Zener diode 126 also connected across the terminals of the battery 42 is included to provide a constant end of charge potential to the battery during recharging of that battery. Diode 126 also minimizes battery overcharging. Finally, the bulb 32 is connected in the circuit as shown, with a capacitor 128 connected thereacross to reduce flicker.

Using the recharging unit in FIG. 9, recharging current is applied to the terminals 86*c* and 90*c* of the circuit 38 in FIG. 12. As noted, the resistor 110 limits current during dc charging. When the switch 112 is in the position shown in full lines in FIG. 12, the battery undergoes recharging.

When the recharging unit 92 of FIG. 10 is used, the terminals of the circuit of FIG. 12 that are utilized are terminals 86*c* and 88*c*. In this case there is no need for the current limiting resistor 110.

Using the recharging unit 104 of FIG. 11, this unit also operates, like the unit of FIG. 10, to transform 115 volt alternating current supply to a dc supply potential suitable for battery recharging. Again, the terminals 86*c* and 88*c* in the circuit of FIG. 12 are utilized during the recharging operation. Should the alternating current supply fail for some reason, the transistor 106 included in the recharging unit 104, which may be a Darlington transistor, senses this condition and becomes conductive with respect to the two output conductors connected to the terminals 88*b* and 84*b*. Thus, when that transistor becomes conductive, the terminals 88*c* and 84*c* in FIG. 12 are effectively connected together. Thus, the positive potential from the battery 42, which is decoupled from the bulb 32 in the full line position of the switch 112 shown in FIG. 12, is connected through the connected terminals 88*c* and 84*c* to the bulb 32, thereby energizing that bulb. Thus, a failure in the recharging circuit produces an appropriate light output indication in the bulb 32.

Thus, the single circuit shown in FIG. 12 is useful with all of the recharging units shown in FIGS. 9 to 11, without modification. Thus lamp assemblies with different capabilities may be made and sold involving a single lamp assembly and varying recharging units.

It should be apparent from the above description that the preferred embodiment described above is susceptible of modification. Accordingly, the invention should be taken to be defined by the following claims.

We claim:

1. A rechargeable lamp assembly comprising a lamp unit having a first set of electrical contacts of particular configuration connected to circuit elements within said lamp unit and adapted for releasable connection to a mating second set of electrical contacts, and a mounting unit adapted for releasable mounting of said lamp unit thereto and including said second set of electrical contacts as a part thereof in position to releasably mate with said first set of electrical contacts when said lamp unit is mounted to said mounting unit, said mounting unit including as a part thereof a third set of electrical contacts of said particular configuration electrically connected to said second set of electrical contacts.

2. A rechargeable lamp assembly according to claim 1, in combination with a recharging unit for generating a recharging current for said lamp unit and having as a part thereof a fourth set of electrical contacts of the same configuration as said second set of electrical contacts so as to be releasably connectable to (a) said third set of electrical contacts to recharge said lamp unit when the latter is mounted to said mounting unit, or to (b) said first set of electrical contacts when it is desired to recharge said lamp unit independent of said mounting unit.

3. A rechargeable lamp assembly according to claims 1 or 2, in which said lamp unit comprises a housing for containing a battery for said lamp and said circuit elements, said housing being formed of parts connectable together and including a storage chamber above said battery, and a cover closing off said chamber and slidable for gaining access to said chamber.

4. A rechargeable lamp assembly according to claims 1 or 2 in which said mounting unit includes a spring biased plate, said lamp unit includes a catch plate adapted to engage said spring biased plate to releasably hold said lamp unit to said mounting unit, and an actuating lever coupled to said spring biased plate for actuating the latter to release said catch plate to permit the removal of said unit from said mounting unit.

5. A rechargeable lamp assembly according to claim 4, in which said mounting unit includes trackways, and said lamp unit includes mounting elements slidable in said trackways for mounting said lamp unit to said mounting unit.

6. A rechargeable lamp assembly according to claim 1, in which said lamp unit includes a battery and a bulb energized by said battery, and including one group of electrical contacts energized by said battery and another group of electrical contacts coupled to said bulb, and means releasably connecting said groups of electrical contacts together, whereby said lamp and battery may be electrically disconnected and said one group of contacts energized by said battery may be used as battery power outlet terminals to energize another load.

7. A rechargeable lamp assembly according to claim 1, in which said circuit elements within said lamp unit include a two-terminal battery that energizes the bulb in said lamp unit, at least two contacts of said first set adapted for receiving a recharging current, a switch having at least "bulb operation" and "battery charging" modes and operating to couple said battery to said bulb to energize the latter in said "bulb operation" mode and to decouple one of said battery terminals from a bulb terminal thereby to extinguish said bulb and to couple said battery to said two charging contacts in said "battery charging" mode, and in which a third electrical contact in said first set is connected to said decoupled bulb terminal for applying battery potential to said bulb to operate the latter as desired when said unit is in said "battery charging" mode.

8. A rechargeable lamp assembly according to claim 7, in combination with a recharging unit generating a recharging current for application to said two charging contacts, and including a sensor for sensing absence of said charging current for connecting one of said two charging contacts to said third contact so as to couple said decoupled battery through said third contact to said bulb and thereby energize said bulb to indicate a failure of battery charging.

* * * * *